US009144807B2

(12) United States Patent
Tietze et al.

(10) Patent No.: US 9,144,807 B2
(45) Date of Patent: Sep. 29, 2015

(54) CENTRIFUGE FOR SEPARATING SOLID MATTER FROM A LIQUID AND CENTRIFUGE ROTOR FOR THE SAME

(75) Inventors: Carsten Tietze, Calbe (DE); Gerd Stahl, Falkensee (DE)

(73) Assignee: BOLL & KIRCH FILTERBAU GMBH, Kerpen (DE)

( * ) Notice: Subject to any disclaimer, the term of this patent is extended or adjusted under 35 U.S.C. 154(b) by 1260 days.

(21) Appl. No.: 13/059,320

(22) PCT Filed: Aug. 17, 2009

(86) PCT No.: PCT/IB2009/053620

§ 371 (c)(1),
(2), (4) Date: Apr. 12, 2011

(87) PCT Pub. No.: WO2010/020936

PCT Pub. Date: Feb. 25, 2010

(65) Prior Publication Data

US 2011/0183830 A1 Jul. 28, 2011

(30) Foreign Application Priority Data

Aug. 18, 2008 (DE) ..... 20 2008 011 013 U

(51) Int. Cl.

| | |
|---|---|
| ***B04B 5/00*** | (2006.01) |
| ***B04B 1/14*** | (2006.01) |
| ***B04B 11/04*** | (2006.01) |
| ***F01M 13/04*** | (2006.01) |

(52) U.S. Cl.

CPC . *B04B 5/005* (2013.01); *B04B 1/14* (2013.01); *B04B 11/04* (2013.01); *F01M 13/04* (2013.01); *F01M 2013/0422* (2013.01); *F01M 2250/64* (2013.01)

(58) Field of Classification Search

CPC ..... B04B 7/04; B04B 5/005
USPC ..... 494/47, 48, 56
See application file for complete search history.

(56) References Cited

U.S. PATENT DOCUMENTS

| | | | | | |
|---|---|---|---|---|---|
| 600,597 | A | * | 3/1898 | Rissmuller | 422/232 |
| 622,712 | A | * | 4/1899 | Rissmuller | 494/48 |
| 1,940,812 | A | * | 12/1933 | Roberts | 210/366 |
| 1,947,844 | A | * | 2/1934 | Gish | 494/48 |
| 4,416,655 | A | * | 11/1983 | Bennett | 494/40 |
| 5,441,475 | A | * | 8/1995 | Storruste et al. | 494/48 |
| 6,063,018 | A | * | 5/2000 | Letourneur | 494/12 |
| 6,511,596 | B1 | * | 1/2003 | Bogers | 210/295 |

FOREIGN PATENT DOCUMENTS

| | | | |
|---|---|---|---|
| GB | 2 160 796 | A | 1/1986 |
| JP | 2000 140705 | A | 5/2000 |
| WO | 03/043742 | A1 | 5/2003 |

* cited by examiner

*Primary Examiner* — Charles Cooley
*Assistant Examiner* — Marc C Howell
(74) *Attorney, Agent, or Firm* — Rankin, Hill & Clark LLP

(57) ABSTRACT

A centrifuge for separating solids from a liquid including a centrifuge rotor with a rotor shaft, partially formed as a hollow shaft, and a centrifuging drum, being rotatable with the rotor shaft, wherein the liquid to be separated can be supplied via the cavity of the hollow shaft. To ease emptying of the drum, the centrifuging drum includes a drum lower part and a drum upper part, which bears loosely against the drum lower part. The upper part is guided in an axially movable manner on the shaft and is movable by means of a disengagement mechanism parallel to the rotor axis into an open position in which, for self-emptying of the interior space, the drum parts are spaced apart from one another while they still rotate with the rotor shaft.

24 Claims, 5 Drawing Sheets

CENTRIFUGE FOR SEPARATING SOLID MATTER FROM A LIQUID AND CENTRIFUGE ROTOR FOR THE SAME

The invention relates to a centrifuge for separating solid matter from a liquid, in particular from a lubricating oil of an internal combustion engine, but also from other liquids which contain solids being separated by acceleration, having a centrifuge housing and having a centrifuge rotor comprising a rotor shaft, which is rotatably mounted in the centrifuge housing and which can be driven by means of a separate drive and which is formed partially as a hollow shaft, and a centrifuging drum which can co-rotate with the rotor shaft, to the interior space of which centrifuging drum the liquid to be separated can be supplied via the cavity of the hollow shaft, and which centrifuging drum is provided with at least one outflow opening for liquid to flow out of the interior space. The invention also relates to a centrifuge rotor for a centrifuge for separating solid matter from a liquid, in particular from a lubricating oil of an internal combustion engine, having a rotor shaft which is formed at least partially as a hollow shaft and having a centrifuging drum which can be rotated by means of the rotor shaft, to the interior space of which centrifuging drum the liquid to be separated can be supplied via the cavity of the hollow shaft.

BACKGROUND OF THE INVENTION

In the prior art, it is known to arrange centrifuges, usually in the form of free-jet centrifuges, in the lubricating oil circuit of an internal combustion engine in order that solid matter which may be contained in the lubricating oil, and which may adversely affect the lubricating oil properties of the lubricating oil, is not only filtered out by means of suitable filters but rather is also separated by means of centrifuging and acceleration of a centrifuging drum of the centrifuge. In centrifuges, in continuous operation, the interior space of a centrifuging drum gradually becomes clogged by the separated solid matter, which forms dry caked solid matter which increases the total weight of the centrifuging drum and thus exerts greater loadings on the bearing for mounting the centrifuge rotor in the centrifuge housing. With progressive operating duration, the entire interior space of the centrifuging drum is filled and the separation capability decreases. To re-establish full operating capacity, it has already been proposed to design the centrifuge rotor or the centrifuging drum as an exchangeable part. In GB 2,160,796 A, for example, the centrifuging drum is arranged on the rotor shaft of the centrifuge rotor in a detachable fashion and, as a result of the dismountable design of the centrifuge housing, the centrifuging drum can be exchanged and replaced with a new centrifuging drum after certain operating intervals.

In addition to free-jet centrifuges, centrifuges such as for example laboratory centrifuges are also known in which the centrifuge rotor is driven by means of a separate drive in order to be able to use the centrifuge independently of the pressure of the liquid to be separated by utilizing the centrifugal acceleration and the differences in density between firstly the solid matter particles and secondly the liquid, and to be able to separate solid matter particles out of the liquid. In centrifuges which are driven by external motors, it is possible to attain rotational speeds of the centrifuging drum of greater than 5000 rpm.

SUMMARY OF THE INVENTION

It is an object of the invention to provide a centrifuge which, when installed for example on an internal combustion engine, allows the centrifuging drum to be emptied without the need to perform assembly work on the centrifuge housing.

Said object and others are achieved according to the invention with a centrifuge in that the centrifuging drum comprises a drum lower part and a drum upper part which bears loosely against said drum lower part and which is guided in an axially movable manner on the rotor shaft and which can be moved by means of a disengagement mechanism parallel to the rotor axis into an open position in which, for self-emptying of the interior space, the drum lower part and drum upper part are spaced apart from one another and can rotate with the rotor shaft. As a result of a split design of the centrifuging drum with a drum upper part and a drum lower part which bear against one another substantially only loosely, it is made possible for the centrifuging drum to be opened in order to then effect self-emptying by means of rotation of the rotor shaft when the centrifuging drum is open. In the centrifuge according to the invention, the drum lower part and drum upper part are separated, or spaced apart, by means of a disengagement mechanism with which it is possible for the drum upper part to be raised, in particular moved, relative to the drum lower part parallel to the axis of the rotor shaft, which disengagement mechanism, when activated or active, also permits a rotation of the drum upper part and drum lower part in the emptying position by means of the rotor shaft.

In a preferred embodiment, the disengagement mechanism is connected to a bearing ring on which the drum upper part is rotatably mounted by means of a rotary bearing. In this way, it is possible for the drum upper part of the centrifuging drum to be rotated in a relatively simple manner even when the drum lower part and drum upper part are spaced apart from one another by means of the disengagement mechanism, since the rotary bearing in the bearing ring can serve at least to rotatably support the raised drum upper part, and the bearing ring itself may remain positionally fixed and thus interact with a stationary disengagement mechanism. In the particularly preferred refinement, the disengagement mechanism has a disengagement arm which is mounted in a tiltable fashion on the centrifuge housing and whose one arm section is coupled to the bearing ring and whose other arm section is coupled to an actuating mechanism. As an actuating mechanism, it is possible in particular to use a suitable actuating drive, for example an electric spindle drive or magnetic lifting drive, in order to induce a movement of the one end of the disengagement arm by actuating the actuating drive, which disengagement arm, on account of a centrally or eccentrically arranged tilting bearing, generates an opposing movement of the other disengagement arm which generates a lifting movement for the bearing ring and, via the latter, also of the drum upper part. It is particularly advantageous if the bearing ring is coupled to the arm section with axial play since, in the closed position of the centrifuging drum in which the drum lower part and drum upper part bear against one another, the rotary bearing in the bearing ring, relieved of the load of the weight forces of the centrifuging drum, may then co-rotate with its drum-side bearing shell and is loaded with the weight forces of the centrifuging drum substantially only when the drum lower part and drum upper part are spaced apart from one another by means of the disengagement mechanism, and are consequently situated in an emptying position.

The above-stated object is achieved with a centrifuge rotor in that the centrifuging drum has a drum lower part and a drum upper part which bears loosely against said drum lower part and which is guided in an axially movable fashion on the rotor shaft and which can be moved into an open position in which the drum lower part and drum upper part are spaced apart from one another and can rotate with the rotor shaft. A corresponding centrifuge rotor is preferably used in a centrifuge which has a disengagement mechanism as described further above in order to separate the drum lower part and drum upper part by means of an actuation of the disengagement mechanism and at the same time to ensure that the drum lower part and drum upper part can be rotated by means of the rotor shaft even in the open or emptying position.

It is particularly advantageous both with regard to the centrifuge and also with regard to a centrifuge rotor if a seal, in particular an O-ring, is arranged on an edge web of the drum upper part, which edge web is of cylindrical or preferably funnel-shaped design, in order to seal off the interior space when the centrifuging drum is closed. The drum lower part may preferably be of plate-shaped or disc-shaped design in order that, in the closed state, an edge web of the drum upper part bears against the upper side of the drum lower part with the interposition of, and so as to clamp, the seal, and the sealing function of the seal between the drum lower part and drum upper part can be ensured. In the particularly preferred refinement, to obtain reliable sealing of the interior space even at high rotational speeds of for example more than 5000 rpm which may be introduced into the rotor shaft of the centrifugal rotor by means of the external motor, a pressure-exerting mechanism for increasing the pressure forces between the drum upper part and drum lower part in the closed state of the centrifuging drum engages on the drum upper part. The pressure-exerting mechanism could fundamentally have merely a static force generator such as, for example, a compression spring or the like, by means of which the same compression force or pressure force is permanently exerted on the drum upper part in order to ensure the sealing of the interior space. With the disengagement mechanism, to move the drum upper part, it is necessary merely to build up a counteracting force which is sufficient for overcoming the pressure force of the static force generator. In a particularly advantageous refinement of a centrifuge or of a centrifuge rotor, to obtain reliable sealing between the drum parts, which bear only loosely against one another, of the centrifuging drum even at very high rotational speeds, the pressure-exerting mechanism may comprise a dynamic force generator such as in particular centrifugal-force-regulated pressure-force-generating means. With such centrifugal-force-regulated pressure-force-generating means as a dynamic force generator which serves to generate a variable pressure force which is dependent on the rotational speed of the rotor shaft and therefore of the centrifuging drum, a relatively easy actuation of the disengagement mechanism is made possible for example when the centrifuge rotor is at a standstill, while in operational use, significantly higher pressure forces are obtained than with a static force generator. It is particularly advantageous if the pressure-exerting mechanism has a compression spring as a static force generator and a centrifugal-force-regulated pressure-force-generating means as a dynamic force generator in order to press the drum lower part and drum upper part and in particular the seal which acts between these against one another with the minimum required preload when the centrifuge is at a standstill, and to then increase the pressure force in operational use by means of the dynamic force generator as a function of the rotational speed of the centrifuge rotor.

The centrifugal-force-regulated pressure-force-generating means may in particular be composed of a plurality of, preferably four, pivot levers which are arranged so as to be circumferentially offset and which have centrifugal weights at the free lever ends. The weights and the number of pivot levers are selected as a function of the size of the centrifuging drum and if appropriate depending on the liquid to be separated and the expected maximum rotational speed. The pivot levers may particularly advantageously be pivotably mounted, between the two lever ends, on a hub sleeve which is fixedly mounted on the rotor shaft. The hub sleeve may be fixedly mounted on the rotor shaft in particular by means of a shaft shoulder against which the hub sleeve is clamped for example by means of a threaded ring which is screwed onto a thread on the rotor shaft. If a static force generator such as for example a compression spring is present, said static force generator may then advantageously be supported on the underside of the hub sleeve so as to press the drum upper part against the drum lower part with a preload. It is self-evident that the hub sleeve must leave free a sufficient movement travel in order to be able to move the drum upper part relative to the drum lower part by means of the disengagement mechanism. It is also preferable for the pivot levers to be provided, at the sliding-sleeve-side end, with lugs which, when the centrifuge or centrifuge rotor is at a standstill, bear only loosely against the upper end side of the sliding sleeve or even lie above the end side, spaced apart from the latter. Since the centrifugal-force-regulated pressure-force-generating means do not generate any increase in force when the centrifuge rotor is at a standstill, it is then in principle necessary for only the pressure force of the static force generator to be overcome in order to move the drum upper part relative to the drum lower part. In this refinement, the end side of a sliding sleeve or of the drum upper part passes above the position of the lugs of the pivot lever even after a short movement travel, as a result of which pressure force can also no longer be exerted on the upper drum part or on the sliding sleeve in the event of a rotation of the rotor shaft. The activation or deactivation of the centrifugal-force-regulated pressure-force-generating means consequently takes place preferably by means of the disengagement mechanism, in particular by means of a simple movement of the sliding sleeve upwards by a sufficient distance.

In a centrifuge with self-emptying during operation, or else during a brief deactivation of the centrifuge, it is particularly advantageous if the solid matter particles (caked solid matter) centrifuged from the interior space as a result of rotation during the self-emptying can be collected and/or separately discharged. In one advantageous refinement, it is possible for this purpose for an annular chamber which is open in the direction of the centrifuging drum to be formed, as a collecting chamber for the separated solid matter which is centrifuged from the interior space during the emptying process, on the centrifuge housing around the drum lower part and the annular gap opening when the drum parts are moved apart. In a preferred refinement, the annular chamber may be formed in a plurality of parts and have an annular body, which is mounted on the centrifuge housing, and a dismountable circumferential wall, in order to allow the collecting chamber to be manually cleaned at any time. According to one advantageous refinement, the circumferential wall may be fastened to the annular body so as to be movable parallel to the axis. By moving the circumferential wall into a closing position, in which the circumferential wall bears against the annular body and in which annular seals act between the annular body and the circumferential wall, the annular chamber is then sealed off. Alternatively or in addition, at least one scraper or the like may be arranged in the annular chamber, and the annular body is at least partially rotatable relative to the centrifuge housing, or the circumferential wall is rotatable relative to the annular body in order to move the solid matter, which has been separated and which has collected in the annular chamber, to an ejection opening in the outer wall or in the base of the annular chamber by means of the scraper. For this purpose, the rotation may be generated in particular by hand. It is also preferable for the scraper to be arranged close to the ejection opening and to interact with a positionally fixed guide element which is fastened to the centrifuge housing or to the annular body, in order, by rotating the annular chamber or the circumferential wall and thus actuating the scraper, to reduce the arc spacing between the scraper and guide element and move all the solid matter to the ejection opening. The guide element and scraper may then form interacting stops which limit the pivoting travel of the annular chamber or of the circumferential wall to less than 360°. It may also be advantageous if the annular chamber can be removed from the centrifuge housing and for example pushed upward off the centrifuge housing in order to exchange the annular chamber for a new annular chamber, or to clean the annular chamber, when the centrifuge is assembled, and in particular with the centrifuge rotor is assembled and mounted.

The rotor shaft may in particular be coupled by means of a coupling to a motor, which is fastened to the centrifuge housing, preferably to the lid of the centrifuge housing, as a drive.

Further advantages and refinements of a centrifuge according to the invention and of a centrifuge rotor according to the invention may be gathered from the following description of an exemplary embodiment which is shown schematically in the drawing.

Further, these and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
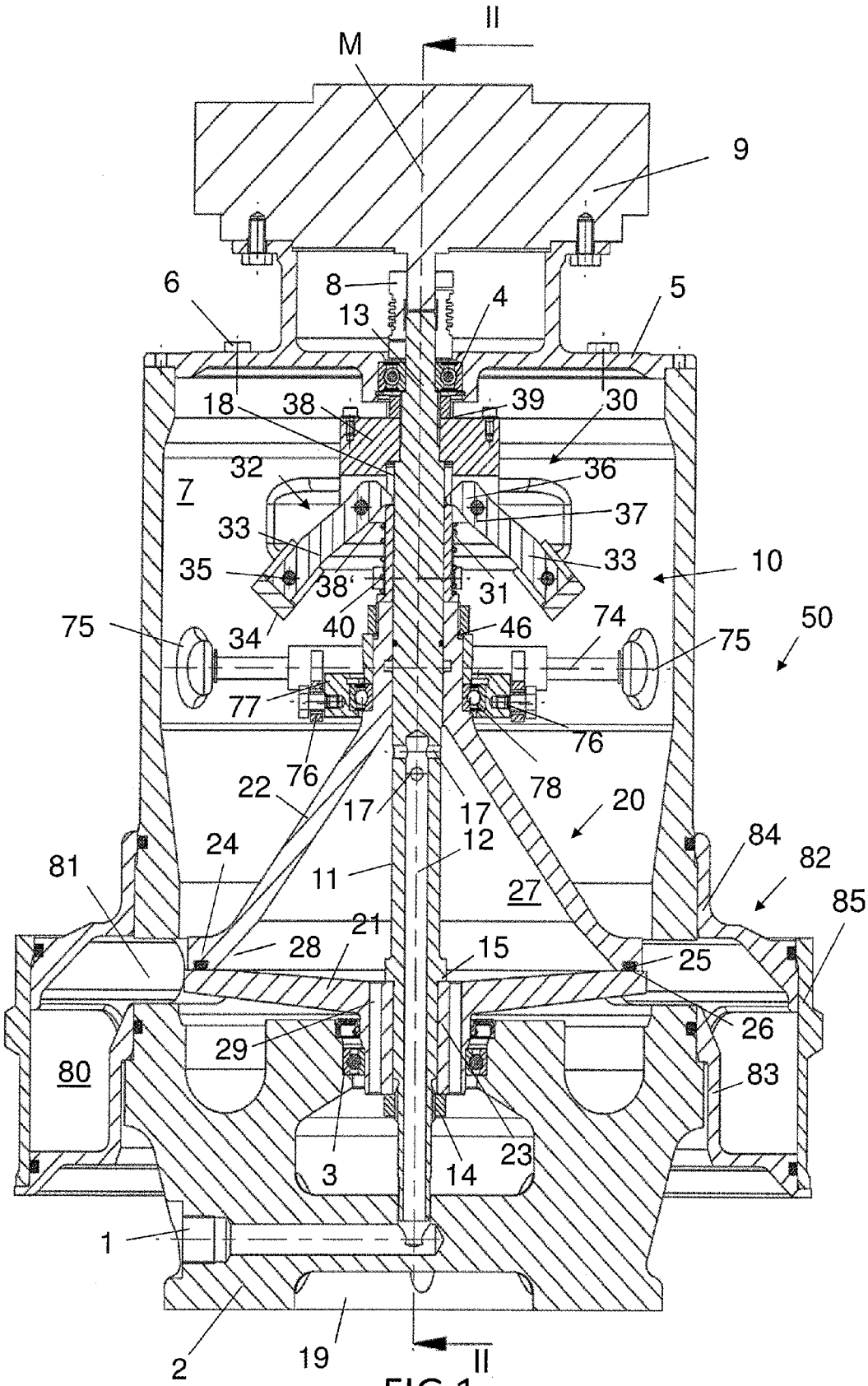
FIG. 1 shows a vertical section through a centrifuge according to the invention in operational use with a rotating centrifuge rotor.

Referring now to the drawings wherein the showings are for the purpose of illustrating preferred and alternative embodiments of the invention only and not for the purpose of limiting same, in the figures, the reference numeral 50 denotes, overall, a centrifuge according to the invention for separating solid matter or solid matter particles from a liquid such as, in particular, a lubricating oil liquid which can be supplied to the centrifuge 50 via an inlet bore 1 in the pedestal part of a centrifuge housing 2. The liquid to be separated flows from the inlet bore 1 into a duct 12 which is formed by the cavity of a rotor shaft 11, which is formed in the lower region as a hollow shaft, of a centrifuge rotor which is denoted overall in the figures by the reference numeral 10. The rotor shaft 11 extends approximately over the entire height of the centrifuge housing 2 and, here, is arranged substantially on the central axis M of the centrifuge housing 2 which is of cylindrical design overall, which central axis M simultaneously forms the rotational axis of the centrifuge rotor 10. The centrifuge rotor 10 is mounted on the centrifuge housing 2 by means of a lower rotary bearing 3, which is formed here by a ball bearing and which bears with its fixed bearing shell against the pedestal part of the centrifuge housing 2, and by means of an upper rotary bearing 4, which is again formed by a ball bearing and which rotatably supports an upper bearing section of the rotor shaft 11 with respect to a lid 5 for closing off the centrifuge housing 2. The lid 5 is fastened to the cylindrical centrifuge housing 2 by means of a plurality of lid screws 6 and surrounds a housing chamber 7 in which the centrifuge rotor 10 is arranged. During separation operation, during the rotation of the centrifuge rotor 10, substantially only the lower rotary bearing 3, which is rotationally fixedly supported on the drum lower part 21 which is fastened to the rotor shaft 11, and the upper rotary bearing 4 which is arranged in the lid part 5, are loaded, with both rotary bearings 3, 4 being composed here of ball bearings.

The upper rotor shaft end 13 of the rotor shaft 11 is coupled by means of a motor coupling 8 to a motor 9, which is flange-mounted on a lid flange of the lid 5 by means of a plurality of fastening screws and which is only schematically illustrated here. The drive output shaft of the motor 9, which may for example be a hydraulic motor or an electric motor, and the shaft end 13 of the rotor shaft 11 are rotationally fixedly connected to one another by means of the motor coupling 8, which may be of rigid or flexible design. The rotational speed of the centrifuge rotor 10 is directly dependent on the rotational speed of the drive output shaft of the motor 9 and may correspondingly be freely selected and set as desired.

Figure 2:
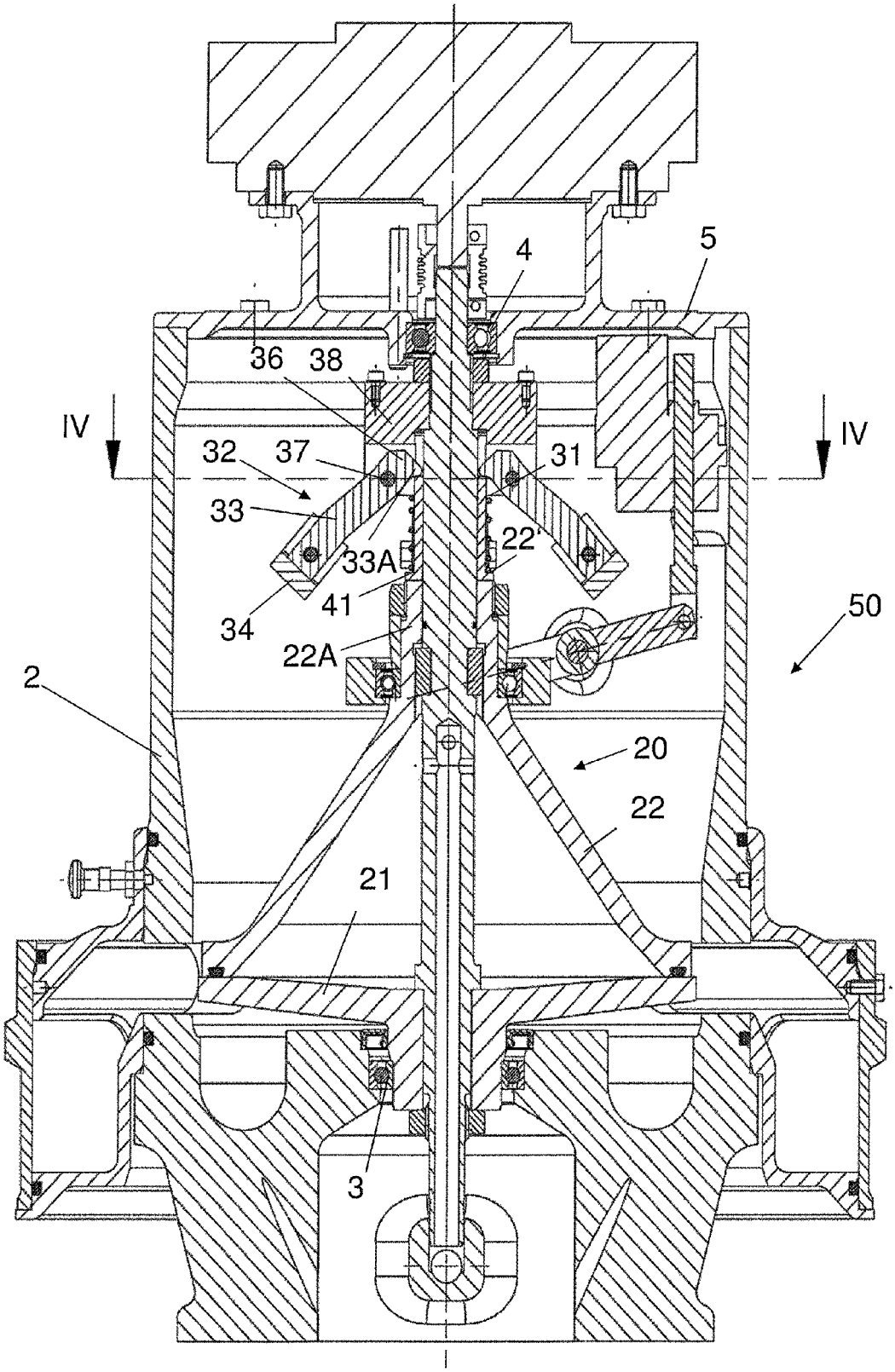
FIG. 2 shows a sectional view along II-II in FIG. 1.

For the separation of the liquid (not illustrated), a centrifuging drum 20 is arranged on the rotor shaft 11, which centrifuging drum 20 is formed here in two parts and is composed of a substantially plate-shaped or disc-shaped drum lower part 21 and a funnel-shaped drum upper part 22. The drum lower part 21 is rotationally fixedly clamped, so as to be fixed in terms of movement, by means of a lower fastening ring 14 against a lower shoulder 15 of the rotor shaft 11, and a lower bearing extension 23 of the drum lower part 21 forms, with its outer circumference, the support surface for the inner bearing shell of the lower rotary bearing 3. The drum upper part 22 of the centrifuging drum 20 bears loosely with the underside of a lower, outer edge web 24 close to the outer circumference of the lower drum part 21 against the upper side of said lower drum part, with a holding groove 25 for a seal, which is formed here by an O-ring 26, being formed here in the underside of the edge web 24. The drum lower part 21 and drum upper part 22 delimit an interior space 27 which, in operational use of the centrifuge 50 as illustrated in FIGS. 1 and 2, is substantially closed off by means of the drum lower part 21 as a base and the drum upper part 22 as a lateral boundary wall, with the seal 26 which acts between the loose contact surfaces sealing off the gap between the drum upper part 22 and drum lower part 21. The liquid to be separated passes via the duct 12 and a plurality of radial bores 17 into the interior space 27 and is subjected to centrifugal forces there on account of the rotation of the centrifuging drum 20, which centrifugal forces become greater the greater the spacing of the liquid from the central axis M. As a result of the rotation of the centrifuging drum 20, solid matter particles are moved radially outward, in a manner known per se, on account of the differences in density between the liquid and the solid matter particles, and said solid matter particles are accumulated at the crotch 28 of the centrifuging drum between the drum lower part 21 and drum upper part 22. On the other hand, the liquid which has been freed from the solid matter particles can flow downward out of the interior space 27 via a plurality of axial bores 29 which form outflow openings for the interior space 27, and can be supplied to an outlet 19 of the centrifuge 50. The centrifuge 50 may be flange-mounted on an internal combustion engine (not shown), and the outlet 19 of the centrifuge then opens out into a lubricating oil sump in the lubricating oil circuit of the internal combustion engine.

Although the drum upper part 22 bears loosely against the plate-shaped drum lower part 21 which rises slightly towards the outer edge at an angle of approximately 3°, it is however provided, in order to ensure the sealing function of the seal 26 even at high rotational speeds, that the drum upper part 22 is pressed against the drum lower part 21 with a sufficiently high pressure force by means of a pressure-exerting mechanism which is denoted overall by the reference numeral 30. In the exemplary embodiment which is shown of a particularly advantageous refinement of a centrifuge 50, the pressure-exerting mechanism 30 has firstly a compression spring 31 as a static force generator and secondly a centrifugal-force-regulated pressure-force-generating means, denoted overall by the reference numeral 32, as a dynamic force generator. The centrifugal-force-regulated, rotational-speed-dependent force generators are composed, in the exemplary embodiment which is shown, of four pivot levers 33 which are arranged around the central axis M of the rotor 11 so as to be offset about the circumference in each case by 90°, to the free ends of which pivot levers 33 centrifugal weights 34 are fastened, in this case by means of in each case one fastening screw 35. FIGS. 1 and 4 show the pivot levers 33, composed of narrow plate webs, with the centrifugal weights 34 in approximately their maximum deflected position on account of the rotation of the centrifuge rotor 10, in which position said centrifugal weights 34 are at their greatest radial distance from the central axis M. The pivot levers 33 are mounted, close to their rotor-shaft-side ends 36, in each case by means of a pivot pin 37 on a hub sleeve 38 so as to be tiltable about a substantially horizontal axis, which hub sleeve 38 is fixedly clamped, by means of a clamping ring 39 which is screwed onto a threaded section on the rotor shaft 11, against a shaft shoulder 18 on the rotor shaft 11, and co-rotates with the rotor shaft 11. The compression spring 31 is supported with its upper end against an underside 38' of the hub sleeve 38, with the compression spring 31 being arranged on the outer circumference of a sliding sleeve 40 and pressing against a web collar 41 of the sliding sleeve 40 in order to preload the sliding sleeve 40 with respect to the hub sleeve 38 in the downward direction in FIGS. 1 to 3. The web collar 41 of the sliding sleeve 40 simultaneously bears against the upper end edge 22' of a cylindrical section 22A of the drum upper part 22 in order to exert a permanently acting static pressure force on the drum upper part 22 via the pressure spring 31 and the sliding sleeve 40, and to preload said drum upper part 22 in the direction of the drum lower part 21. In the operating state, the sliding sleeve 40 is also acted on simultaneously by the centrifugal-force-regulated pressure-force-generating means 32, since the inner, rotor-shaft-side ends 36 of the levers 32 are provided in each case with a rounded lug 33A, by means of which, on account of the deflection of the levers 33, the centrifugal weights 34 and the lever lengths relative to the pivot pins 37, a pressure force which acts in the vertical direction is transmitted to the upper end side of the sliding sleeve 40. With increasing rotational speed of the centrifuge rotor 10, the centrifugal weights 34 experience a higher centrifugal force acceleration, as a result of which the force exerted on the drum upper part 22 via the sliding sleeve 40, and thus also the pressure force between the drum upper part 22 and drum lower part 21, rises in a centrifugal-force-regulated or rotational-speed-dependent fashion and falls with decreasing rotational speed.

Figure 3:
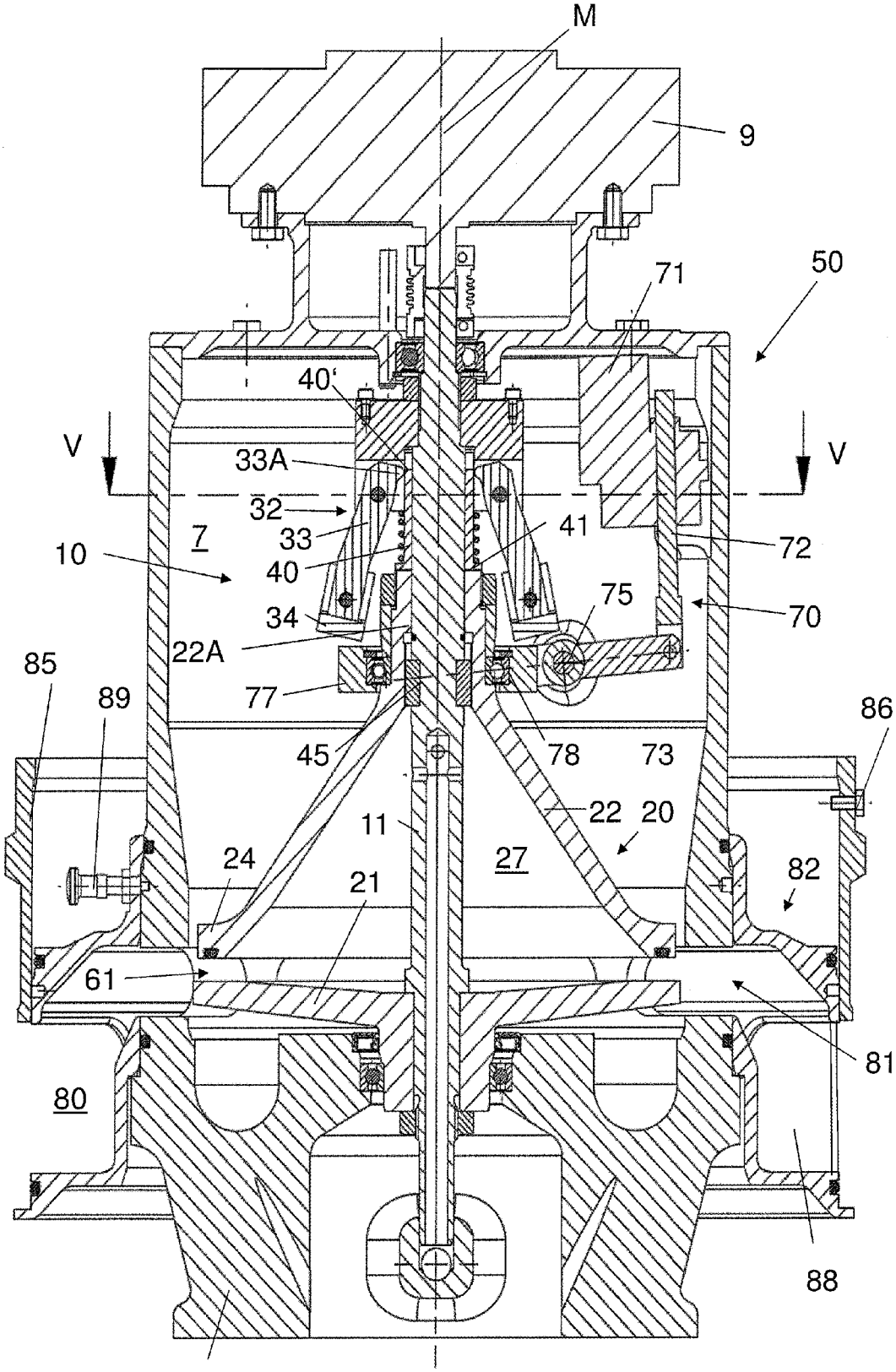
FIG. 3 shows the centrifuge rotor from FIG. 1 with a centrifuging drum in the emptying position.
Figure 4:
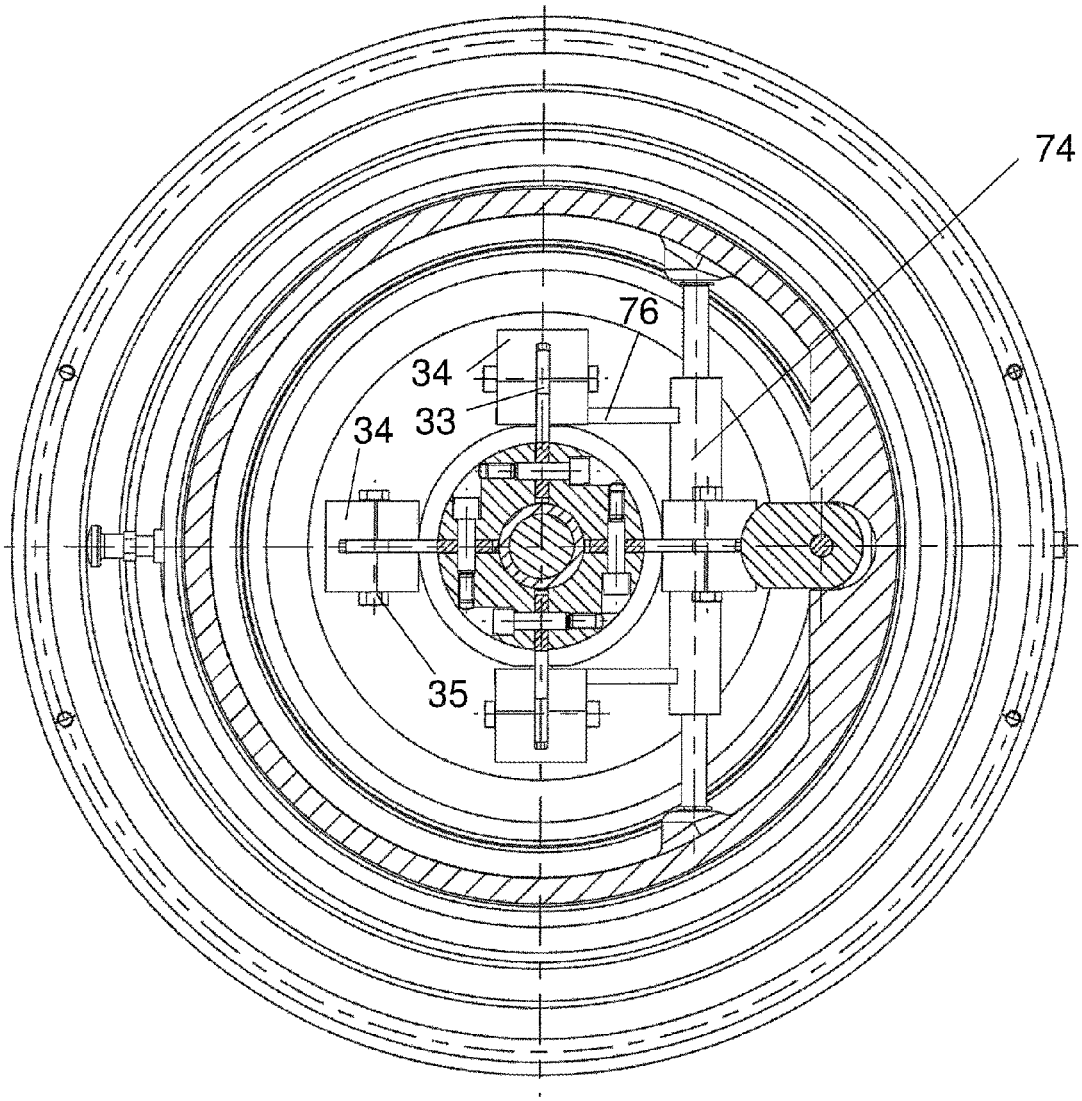
FIG. 4 shows a sectional view along IV-VI in FIG. 2.
Figure 5:
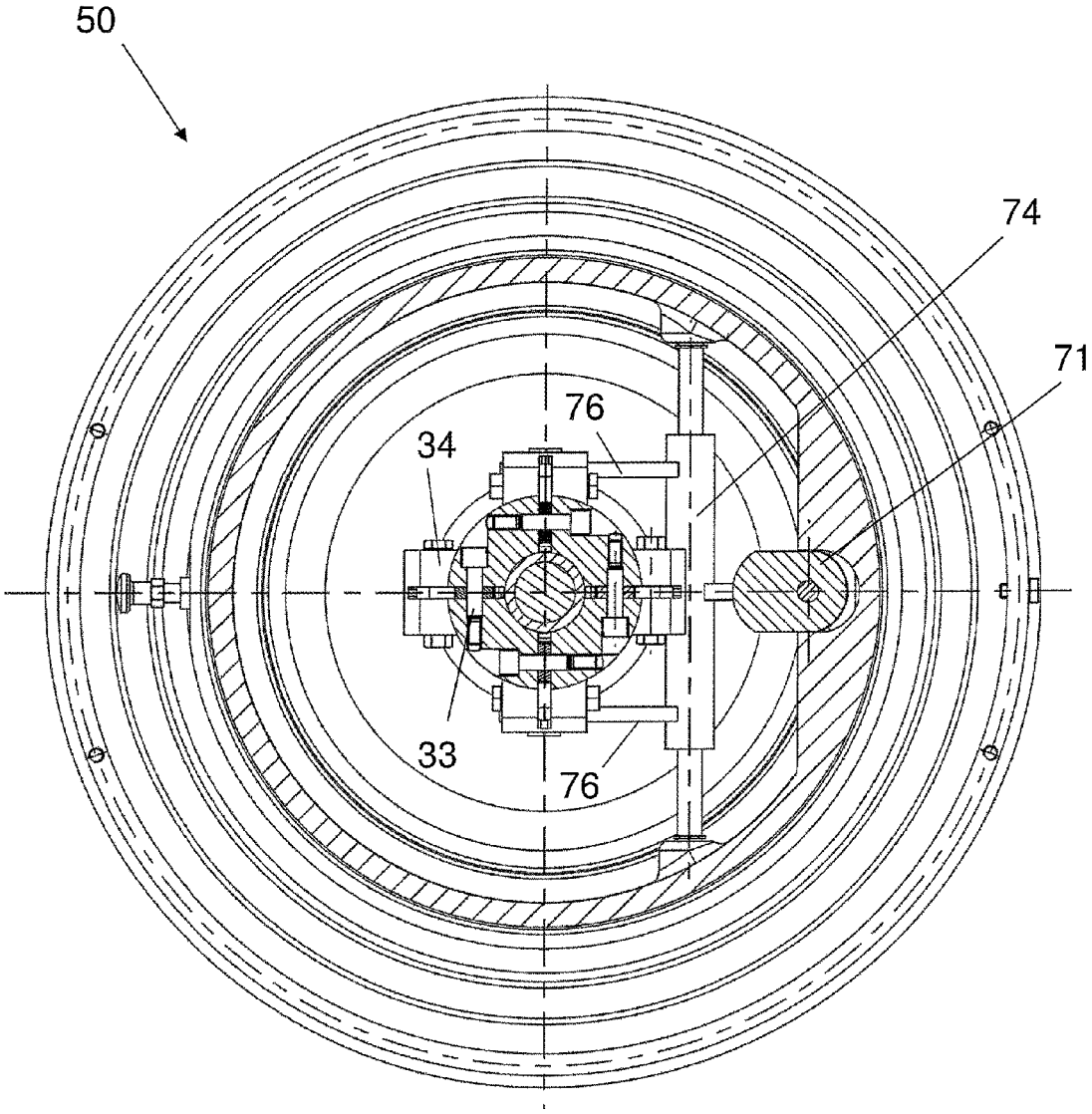
FIG. 5 shows a sectional view along V-V in FIG. 3.

From a comparison of FIG. 3 and FIG. 2, it can be clearly seen that the drum upper part 22 is arranged in an axially movable manner on the rotor shaft 11 and the rotationally fixed connection between the drum upper part 22 and the rotor shaft 11 is provided here by means of two parallel keys 45 which are seated in sliding grooves on the inner casing of the cylindrical section 22A of the drum upper part 22 and which generate a rotationally fixed connection between the drum upper part 22 and rotor shaft 11 independently of the position of the drum upper part 22 in the closed position of the interior space 27 of the centrifuging drum 20, as shown in FIG. 2, or the open position of the centrifuging drum 20, as shown in FIG. 3. The movement of the drum upper part 22 relative to the drum lower part 21 parallel to the axis of the rotor shaft 11 generates a spacing of the edge web 24, such that the interior space 27, on account of the spacing at the circumference, is provided with an annular gap, which is denoted in FIG. 3 by the reference sign 61. The upward movement of the drum upper part 22 on the rotor shaft 11 takes place preferably when the centrifuge rotor 10 of the centrifuge 50 is at a standstill, by means of a disengagement mechanism 70 which is actuated by a schematically indicated actuating drive 71 which is arranged here in the housing chamber 7. The actuating drive 71 moves, by means of the actuating plunger 72, the projecting end of a disengagement arm 73 downwards, which disengagement arm 73 is supported at both sides of the rotor shaft 11 by means of a tilting axle 74 in each case one pivot bearing 75, and has, at both sides of the rotor shaft 11, a fork-shaped projecting arm section 76 which is coupled to a bearing ring 77 with a sufficient degree of vertical movement play. The bearing ring 77 serves to support a third rotary bearing 78 which is in turn composed of a ball bearing and whose rotor-side bearing shell is fixedly connected by means of the clamping ring 46 to the drum upper part 22 and which is preferably fastened to a bearing seat on the outer circumference of the cylindrical section 22A. The third rotary bearing 78 performs its function only when the drum upper part 22 is moved into the open position shown in FIG. 3 by means of a pivoting movement of the pivot arm 73 about the tilting axle 74 or the pivot bearing 75. In the position shown in FIG. 3, the drum upper part 22 can still co-rotate with the rotor shaft 11, even though the bearing ring 77 has been moved upwards by means of the disengagement mechanism 70 and the weight forces of the drum upper part 22 are consequently supported by means of the bearing ring 77 and the third rotary bearing 78. The upward axial movement of the drum upper part 22 also generates an axial movement of the sliding sleeve 40 to at least such an extent that, as shown particularly clearly in FIG. 3, the compression spring 31 is compressed to a greater extent, as a result of which the drum upper part 22 can rotate, supported by the rotary bearing 78, without vibration even in the raised open position. At the same time, however, the contact of the lugs 33A of the levers 33 is changed or eliminated as a result of the sliding movement of the sliding sleeve 40, since, in the open position of the centrifuging drum 20, the lugs 33A no longer bear against the upper end side, as in the closed state of the centrifuging drum 20 shown in FIG. 1, but rather now bear against the outer circumference of the sliding sleeve 40, for which reason even a rotation of the centrifuge rotor 10 at a high rotational speed does not lead to a significant deflection of the lever arms 33 or of the centrifugal weights 34. In fact, the positively locking contact of the lugs 33A with the casing of the sliding sleeve 40 prevents a pivoting of the lever arms 33, and the lever arms 33 and the centrifugal weights 34 therefore remain, as shown particularly clearly in FIGS. 3 and 5, in a pivoting position in which said lever arms 33 and centrifugal weights 34 are at the minimum radial distance from the central axis M or the rotor shaft 11. The centrifugal-force-regulated force generators 32 therefore exert no pressure forces on the drum upper part 22 when the centrifuging drum 20 is open, as a result of which the rotary bearing 78 on the bearing ring 77, which serves to ensure the rotatability of the drum upper part 22 which has been moved into the open position, is in turn relieved of load.

If, in the open position shown in FIG. 3, the centrifuge 50 or the centrifuge rotor 10 is now set in rotation again by means of the motor 9, solid matter particles, or caked solid mater particles, which have been deposited in the interior space 27 of the centrifuging drum 20 in separation operation are centrifuged outwards through the annular gap 61, thereby providing self-emptying of the interior space 27. For self-emptying, it is necessary merely to briefly deactivate the centrifuge 50, actuate the disengagement mechanism 70 to open the centrifuging drum 20, and briefly accelerate the centrifuge rotor 10 when the drum 20 is open.

To bring the solid matter particles which have been centrifuged out of the interior space 27 together and to discharge said particles together without the liquid flow of the liquid to be separated being loaded, an annular chamber 80 is formed concentrically around the drum lower part 21 or the annular gap 61, into which annular chamber 80 the solid matter particles are centrifuged via a plurality of, for example four, slots 81, which are separated from one another by narrow housing webs, in the casing wall of the centrifuge housing 2 when the centrifuging drum 20 is open. The annular chamber 80 itself forms a lower collecting chamber for centrifuged solid matter particles, which lower collecting chamber extends downwards, proceeding from the drum lower part 21, outside the centrifuge housing 2. The annular chamber 80 is formed in a plurality of parts and has an annular body 82 which bears with a lower annular web 83 and an upper annular web 84, sealed off in each case by means of O-rings, against the outer casing of the centrifuge housing 2, which annular body 82 is provided with a dismountable cylindrical circumferential wall 85 which, as again shown by a comparison of FIGS. 1 and 3, can be moved parallel to the central axis M between a closed position (FIG. 1), in which the annular chamber 80 is closed, and an open position (FIG. 3), in which the annular chamber 80 would be freely accessible and open from the outside. To prevent an inadvertent opening of the annular chamber 80, the circumferential wall 85 can be fixed by means of at least one fastening screw 86 to the annular body 82.

The annular body 82 could be fixedly fastened to the centrifuge housing 2 by means of a plurality of fastening screws. According to one advantageous refinement, the annular body 82, sealed off by means of the O-rings which are shown as seals, is supported in a rotatable and dismountable fashion against the lower part of the centrifuge housing 2, and/or the circumferential wall 85, again sealed off by means of O-rings which permit movements and relative rotations, is rotatably fastened to the annular body. A rotatable fastening of the annular chamber 80 or of the circumferential wall 85 has particular advantages if the annular chamber 80 is provided with a base opening or side opening as an ejection opening, and a scraper 88 projects into the annular chamber 80 in order to move the solid matter in the annular chamber to the opening by means of a rotation of the annular body 82 relative to the centrifuge housing 2 or of the circumferential wall 85 relative to the annular body 82. By means of a scraper 88 which is arranged close to the ejection opening and a guide plate (not illustrated) which is, for example, fixedly fastened to the centrifuge housing 2 if the annular body is rotatable or to the annular body 82 if the circumferential wall is rotatable, it is possible to push the solid matter, or a deposited mass, into the ejection opening by reducing the angular spacing between said scraper and guide plate. It is self-evident that, in separation operation, it is preferable for the scraper 88 and guide element to bear directly against one another, with the guide element simultaneously forming a rotation-limiting facility for the annular body 82. It can also be seen from FIGS. 1 to 3 that the annular chamber 80 as a whole can be pushed upwards off the centrifuge housing 2 if the locking screw 89 is released. It is possible for the annular chamber 80 with the separated caked solid matter to be exchanged without the lid 5 of the centrifuge housing 2 being screwed on and without influencing the mounting of the rotor shaft 11.

A person skilled in the art will gather numerous modifications from the above description, wherein it is intended that the scope of protection of the dependent claims encompasses said modifications. The actuation of the disengagement mechanism and the arrangement of the disengagement mechanism could take place in some other way. Depending on the embodiment, it would also be possible to use three or more than four centrifugal weights. If only low rotational speeds are to be expected, a correspondingly strong compression spring could if appropriate be sufficient to ensure the sealed function of the interior space of the centrifuging drum in the closed state. The above description was based on the preferred use of the centrifuge according to the invention for separating lubricating oil of an internal combustion engine, such as for example an engine of a ship or train drive. It is also possible for the centrifuge to be used to separate other liquids, such as for example olive oil, wine, vinegar or the like, which are generally laden or contaminated with solid matter particles as impurities.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A centrifuge for separating solid matter from a liquid, in particular from a lubricating oil of an internal combustion engine, comprising a centrifuge housing and a centrifuge rotor including a rotor shaft, which is rotatably mounted in the centrifuge housing, which is drivable by a separate drive and which is formed partially as a hollow shaft, and having a centrifuging drum, being rotatable with the rotor shaft, the centrifuging drum comprises an interior space being suppliable with the liquid to be separated via a cavity of the hollow shaft, wherein the centrifuging drum is provided with at least one outflow opening for liquid to flow out of the interior space, the centrifuging drum comprising a drum lower part and a drum upper part which bears against the drum lower part and which is guided in an axially movable manner on the rotor shaft and which is movable by a disengagement mechanism parallel to the rotor axis into an open position in which, for self-emptying of the interior space, the drum lower part and drum upper part are spaced apart from one another and are rotatable with the rotor shaft wherein a pressure-exerting mechanism for increasing the pressure forces between the drum upper part and drum lower part in the closed state of the centrifuging drum engages on the drum upper part, the pressure-exerting mechanism includes pressure-force-generating means which is controlled by centrifugal force, the centrifugal-force-regulated pressure-force-generating means is at least one of activateable or deactivatable by means of the disengagement mechanism.

2. A centrifuge according to claim 1, wherein the disengagement mechanism is coupled to a bearing ring on which the drum upper part is rotatably mounted by means of a rotary bearing.

3. A centrifuge according to claim 2, wherein the disengagement mechanism has a disengagement arm which is mounted in a tiltable fashion on the centrifuge housing and whose one arm section is coupled to the bearing ring and whose other arm section is coupled to an actuating mechanism.

4. A centrifuge according to claim 3, wherein the bearing ring is coupled to the arm section with axial play.

5. A centrifuge according to claim 4, wherein the disengagement arm is designed as a fork arm which coupleable to the bearing ring at both sides of the rotor shaft.

6. A centrifuge according to claim 1, wherein a seal is arranged on an edge web of the drum upper part in order to seal off the interior space when the centrifuging drum is closed.

7. A centrifuge according to claim 1, wherein the pressure-exerting mechanism has a compression spring as a static force generator and a centrifugal-force-regulated pressure-force-generating means as a dynamic force generator.

8. A centrifuge according to claim 7, wherein the static force generator and the centrifugal-force-regulated pressure-force-generating means act on a sliding sleeve which is guided on the rotor shaft in an axially movable fashion.

9. A centrifuge according to claim 8, wherein the centrifugal-force-regulated pressure-force-generating means includes of a plurality of pivot levers which are arranged so as to be circumferentially offset and which have centrifugal weights at the free lever ends, the plurality of pivot levers being provided, at a sliding-sleeve-side end, with lugs which, when the centrifuge is at a standstill, at least one of bear loosely against an upper end side of the sliding sleeve or lie above the upper end side.

10. A centrifuge according to claim 1, wherein an annular chamber which is open in the direction of the centrifuging drum is formed, as a collecting chamber for separated solid matter which is centrifuged from the interior space during the emptying process, on the centrifuge housing around the drum lower part.

11. A centrifuge according to claim 10, wherein the annular chamber is formed in a plurality of parts and has an annular body, which is mounted on the centrifuge housing, and a dismountable circumferential wall, with the circumferential wall being fastened to the annular body so as to be movable parallel to the axis, and sealingly closing off the annular chamber by means of annular seals in a closing position.

12. A centrifuge according to claim 11, wherein at least one scraper is arranged in the annular chamber, and at least one of the annular body being at least partially rotatable relative to the centrifuge housing and the circumferential wall being at least partially rotatable relative to the annular body, in order to move solid matter to an ejection opening in the annular chamber by means of the scraper.

13. A centrifuge according to claim 12, wherein the scraper is arranged close to the ejection opening and interacts with a positionally fixed guide element which is fastened to at least one of the centrifuge housing and the annular body.

14. A centrifuge according to claim 10, wherein the annular chamber is removable from the centrifuge housing.

15. A centrifuge according to claim 1, wherein the rotor shaft is rotationally fixedly coupleable by a coupling to a motor, which is flange-mounted on the centrifuge housing.

16. A centrifuge for separating solid matter from a liquid, in particular from a lubricating oil of an internal combustion engine, comprising a centrifuge housing and a centrifuge rotor including a rotor shaft, which is rotatably mounted in the centrifuge housing, which is drivable by a separate drive and which is formed partially as a hollow shaft, and having a centrifuging drum, being rotatable with the rotor shaft, the centrifuging drum comprises an interior space being suppliable with the liquid to be separated via a cavity of the hollow shaft, wherein the centrifuging drum is provided with at least one outflow opening for liquid to flow out of the interior space, the centrifuging drum comprising a drum lower part and a drum upper part which bears against the drum lower part and which is guided in an axially movable manner on the rotor shaft and which is movable by a disengagement mechanism parallel to the rotor axis into an open position in which, for self-emptying of the interior space, the drum lower part and drum upper part are spaced apart from one another and are rotatable with the rotor shaft wherein a pressure-exerting mechanism for increasing the pressure forces between the drum upper part and drum lower part in the closed state of the centrifuging drum engages on the drum upper part, the pressure-exerting mechanism includes pressure-force-generating means which is controlled by centrifugal force, the pressure-exerting mechanism has a compression spring as a static force generator and a centrifugal-force-regulated pressure-force-generating means as a dynamic force generator, the static force generator and the centrifugal-force-regulated pressure-force-generating means act on a sliding sleeve which is guided on the rotor shaft in an axially movable fashion, the sliding sleeve is movable by means of the disengagement mechanism into a position in which no force is transmitted by the centrifugal-force-regulated pressure-force-generating means to the drum upper part.

17. A centrifuge according to claim 16, wherein the centrifugal-force-regulated pressure-force-generating means includes of a plurality of pivot levers which are arranged so as to be circumferentially offset and which have centrifugal weights at the free lever ends.

18. A centrifuge according to claim 17, wherein the plurality of pivot levers are pivotably mounted on a hub sleeve which is fixedly mounted on the rotor shaft, with the hub sleeve being fixed to the rotor shaft by at least one of a shaft shoulder and a static force generator being supported on an underside of the hub sleeve.

19. A centrifuge according to claim 16, wherein an annular chamber which is open in the direction of the centrifuging drum is formed, as a collecting chamber for separated solid matter which is centrifuged from the interior space during the emptying process, on the centrifuge housing around the drum lower part.

20. A centrifuge rotor for a centrifuge for separating solid matter from a liquid, in particular from a lubricating oil of an internal combustion engine, having a rotor shaft which is formed at least partially as a hollow shaft and having a centrifuging drum which is rotatable by the rotor shaft, to the interior space of which centrifuging drum the liquid to be separated is suppliable via a cavity of the hollow shaft, the centrifuging drum comprising a drum lower part and a drum upper part which bears loosely against the drum lower part and which is guided in an axially movable fashion on the rotor shaft and which is movable into an open position in which the drum lower part and drum upper part are spaced apart from one another and are rotatable with the rotor shaft wherein a pressure-exerting mechanism for increasing the pressure forces between the drum upper part and drum lower part in the closed state of the centrifuging drum engages on the drum upper part and the pressure-exerting mechanism includes pressure-force-generating means which are controlled by centrifugal force, the centrifugal-force-regulated pressure-force-generating means includes a plurality of pivot levers which are arranged so as to be circumferentially offset and which have centrifugal weights at the free lever ends, the plurality of pivot levers are pivotably mounted on a hub sleeve which is fixedly mounted on the rotor shaft, with the hub sleeve being fixed to the rotor shaft by at least one of a shaft shoulder and a static force generator being supported on an underside of the hub sleeve.

21. A centrifuge rotor according to claim 20, wherein a seal is arranged on an edge web of the drum upper part in order to seal off the interior space when the centrifuging drum is closed.

22. A centrifuge rotor according to claim 20, wherein the pressure-exerting mechanism has a compression spring as a static force generator and a centrifugal-force-regulated pressure-force-generating means as a dynamic force generator.

23. A centrifuge rotor according to claim 22, wherein the static force generator and the centrifugal-force-regulated pressure-force-generating means act on a sliding sleeve which is guided on the rotor shaft in an axially movable fashion.

24. A centrifuge rotor according to claim 23, wherein the centrifugal-force-regulated pressure-force-generating means includes of a plurality of pivot levers which are arranged so as to be circumferentially offset and which have centrifugal weights at the free lever ends, the plurality of pivot levers being provided, at a sliding-sleeve-side end, with lugs which, when the centrifuge is at a standstill, at least one of bear loosely against an upper end side of the sliding sleeve and lie above the upper end side.

* * * * *